US007850160B2

(12) United States Patent
Kato et al.

(10) Patent No.: US 7,850,160 B2
(45) Date of Patent: Dec. 14, 2010

(54) SHEET PROCESSING APPARATUS AND IMAGE FORMING SYSTEM

(75) Inventors: Norishige Kato, Hachioji (JP); Takehiro Ogushi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 585 days.

(21) Appl. No.: 11/903,253

(22) Filed: Sep. 21, 2007

(65) Prior Publication Data

US 2008/0199277 A1 Aug. 21, 2008

(30) Foreign Application Priority Data

Feb. 20, 2007 (JP) ..... 2007-039124

(51) Int. Cl.

| | |
|---|---|
| ***B65H 33/04*** | (2006.01) |
| ***B65H 39/00*** | (2006.01) |
| ***B65H 43/00*** | (2006.01) |
| ***B41L 43/10*** | (2006.01) |
| ***G03G 15/14*** | (2006.01) |

(52) U.S. Cl. ..... 270/58.09; 270/37; 270/59; 399/402

(58) Field of Classification Search ..... None
See application file for complete search history.

(56) References Cited

U.S. PATENT DOCUMENTS

| | | | | |
|---|---|---|---|---|
| 7,613,422 | B2 * | 11/2009 | Shida et al. | 399/407 |
| 2007/0170631 | A1 * | 7/2007 | Kato et al. | 270/37 |

FOREIGN PATENT DOCUMENTS

| | | | |
|---|---|---|---|
| JP | 11-334244 | A | 12/1999 |
| JP | 2003-25754 | A | 1/2003 |
| JP | 2003-025755 | A | 1/2003 |
| JP | 2003025754 | A * | 1/2003 |
| JP | 2004-155152 | A | 6/2004 |
| JP | 2005-335262 | A | 12/2005 |

OTHER PUBLICATIONS

Japanese Office Action dated Mar. 10, 2009 (2 pages), and English translation thereof (3 pages) issued in counterpart Japanese Application No. 2007-039124.

* cited by examiner

*Primary Examiner*—Gene Crawford
*Assistant Examiner*—Yolanda Cumbess
(74) *Attorney, Agent, or Firm*—Holtz, Holtz, Goodman & Chick, PC

(57) ABSTRACT

A sheet processing apparatus, including: a booklet making section for making a booklet by covering a sheet bundle comprised of a plurality of sheets with a cover in a U-shape; a folding section for forming a fold-line on a coversheet, which covers the booklet made by the book making section; cover sheet conveyance section for conveying the coversheet; a measurement section for measuring a thickness of the sheet bundle; and a control section for controlling operations of the cover sheet conveyance section and the folding section to determine a folding position on the coversheet and form a fold-line on the folding position; wherein the folding position has been determined based on size information of the coversheet, size information of a sheet of the sheet bundle and thickness information of the sheet bundle measured by the measurement section.

8 Claims, 17 Drawing Sheets

SHEET PROCESSING APPARATUS AND IMAGE FORMING SYSTEM

This application is based on Japanese Patent Application No. 2007-039124 filed on Feb. 20, 2007 with the Japanese Patent Office, the entire content of which is hereby incorporated by reference.

FIELD OF THE INVENTION

This invention relates to a sheet processing apparatus and an image forming system for folding a coversheet for covering a booklet.

BACKGROUND OF THE INVENTION

Unexamined Japanese Patent Application Publication No. 2005-335,262 discloses a sheet processing apparatus for simply making a booklet by covering a sheet bundle comprised of a plurality of sheets with a cover in a U-shaped style, onto which images have been formed by an image forming apparatus, such as a copier and a printer.

The general outline of a technique for making a booklet will be described. Firstly, a plurality of sheets carrying the images are collected and aligned, being a sheet bundle. Then, adhesive agent is applied onto one surface of the sheet bundle. A coversheet is conveyed to a predetermined position, where the coversheet is attached to the surface of the sheet bundle onto which the adhesive agent has been coated. The plurality of sheets and the cover are formed into one body as a booklet, as described above.

FIG. 17 illustrates an example of booklets made by the sheet processing apparatus. FIG. 17(*a*) illustrates the situation where a cover S2 has not been folded and FIG. 17(*b*) illustrates the situation where the covers S2 has been folded. A booklet S3 is structured by a sheet bundle comprised of a plurality of sheets S1 and a cover S2. The booklet S3 is arranged so that the sheets S1 is covered by the cover S2 in a U-shaped style while symbol S3E is a spine. The positions of the side edge section S1E of the sheets S1 and the side edge section S2E of the cover S2 are matched in a final style of the booklet S3.

Unexamined Japanese Patent Application Publication No. 2003-25,755 discloses a sheet processing apparatus (a bookbinding apparatus) for automatically putting a coversheet so as to cover the cover of a booklet made by the sheet processing apparatus.

This sheet processing apparatus is arranged so that a folding roller folds a coversheet along the cover in response to the booklet. According to this sheet processing apparatus, since the booklet having a coversheet thereon is automatically outputted, a user does not need to put coversheet on the booklet.

According to the sheet processing apparatus (a bookbinding apparatus) disclosed by the Unexamined Japanese Patent Application Publication No. 2003-25,755 has an effect, from the viewpoint that a user can save time because the sheet processing apparatus automatically attach a coversheet onto the booklet. However, in case when the sheet processing apparatus automatically attaches the coversheet onto the booklet, it takes time to attach the coversheet onto the booklet. Thus, it is not efficient from the viewpoint of booklet productivity. Accordingly, there is an idea that a sheet processing apparatus is arranged to separately output a booklet and a coversheet without outputting a coversheet with a booklet from the viewpoint of the booklet productivity. In this case, since a user needs to put a coversheet onto the booklet, it is preferable that the sheet processing apparatus is arranged to form a fold-line on the coversheet before outputting it. The fold-line will be studied by using FIG. 18.

FIG. 18 illustrates the relationship between sheets S3 configuring a booklet, a cover S2 and a coversheet CV. FIG. 18(*a*) illustrates a situation where the cover S2 and the coversheet CV have not been folded, and FIG. 18(*b*) illustrates the situation where the coversheet CV has been open. In FIG. 18(*a*), in order to understand the relationship between the cover S2 and the coversheet CV, the cover S2 and the coversheet CV haven shifted each other. The dashed lines in FIG. 18(*a*) and FIG. 18(*b*) indicate the fold-lines on the coversheet CV. "X" in the FIG. 18(*b*) indicates the length of the coversheet CV, "A" denotes the thickness of the sheets S1 (which is also the width of the spine of the cover S2) and "B" denotes the lateral width of the sheet S1.

In case when the fold-line is not formed on an appropriate position of the coversheet, when the coversheet CV is attached on the booklet S3, since the edge of the booklet S3 and the fold-line of the coversheet CV do not match each other, appearance is not good. Further, when forming an image onto the coversheet CV, when the image formation position on the coversheet is not appropriate, there is a possibility that the image appears on the fold-line of the coversheet.

SUMMARY OF THE INVENTION

It is therefore, an object of the present invention is to provide a sheet processing apparatus, which is capable of forming a fold-line on an appropriate position on a coversheet. Another object of the present invention is to provide an image forming system, which is capable of forming an image on an appropriate position on a coversheet.

These and other objects of the present invention are accomplished by a sheet processing apparatus, including a booklet making section for making a booklet by covering a sheet bundle comprised of a plurality of sheets with a cover in a U-shape, and a fold-line forming section for forming a fold-line on a coversheet, which covers the booklet made by the book making section, wherein the sheet processing apparatus includes a cover sheet conveyance section for conveying the coversheet, a measurement section for measuring a thickness of the sheet bundle comprised of a plurality of sheets, and a control section for controlling operations of the cover sheet conveyance section and the fold-line forming section to determine a folding position on the coversheet and form a fold-line on the folding position, which has been determined, based on size information of the coversheet, size information of a sheet of the sheet bundle and thickness information of the sheet bundle measured by the measurement section.

An image forming system of the present invention including a sheet processing apparatus, having:

a booklet making section for making a booklet by covering a sheet bundle comprised of a plurality of sheets with a cover in a U-shape, and a fold-line forming section for forming a fold-line on a coversheet which covers the booklet made by the booklet making section, and an image forming apparatus for forming an image onto the coversheet, wherein the image forming system includes a measurement section for measuring a thickness of the sheet bundle, and a control section for controlling operations of the image forming apparatus to determine an image forming position on the coversheet and form an image on the image forming position, which has been determined based on size information of the coversheet, size information of a sheet of the sheet bundle, and thickness information of the sheet bundle measured by the measurement section.

DETAILED DESCRIPTION OF THE INVENTION

Figure 1:
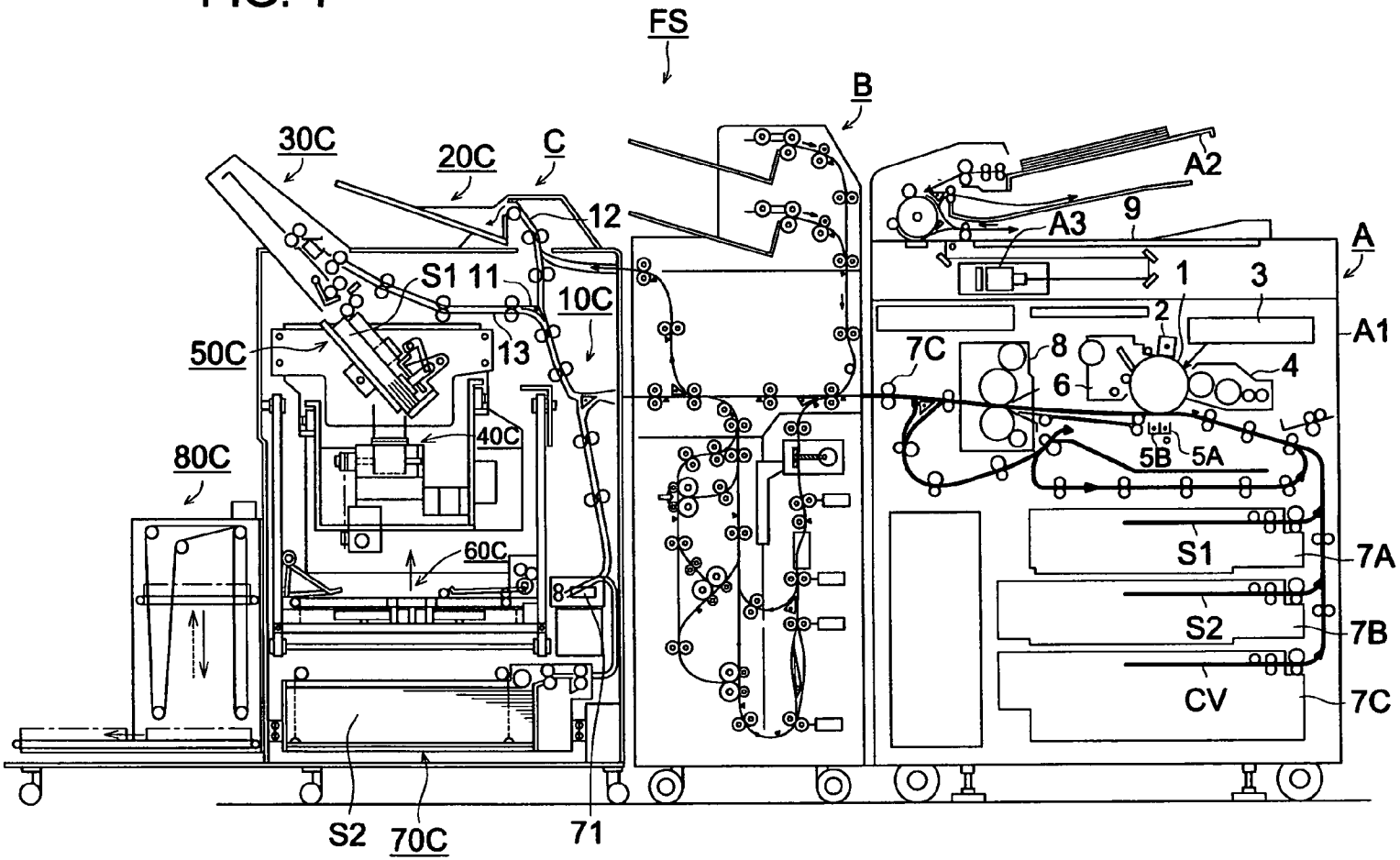
FIG. 1 illustrates a center-cross sectional view of an image forming system.

FIG. 1 illustrates a center-cross sectional view of an image forming apparatus.

The image forming system includes an image forming apparatus A and a sheet processing apparatus FS. The sheet processing apparatus FS is configured by a sheet folding apparatus B and a bookbinding apparatus C.

The image forming apparatus A serves as an image forming apparatus for forming an image onto a sheet S1 by an electro-photographic system. The image forming apparatus A includes an image formation section A1, a document conveyance section A2 and an image reading section A3. In the image formation section A1, a charge section 2, an exposure section 3, a development section 4, a transfer section 5A, a separation section 5B and a cleaning section 6 are disposed around a photoconductor 1 having a drum shape where respective processes, such as charge, exposure, development and transfer are executed to form a toner image onto the sheet S1.

A sheet feeding tray 7A stores sheets S1 for covering a cover S2 when a booklet is made, and a sheet feeding tray 7B and a cover storage section 70C in the bookbinding apparatus C stores covers S2. The sheet feeding tray 7C stores coversheets CV for covering the booklet made by the bookbinding apparatus C.

The sheet S1 is ejected one by one from the sheet feeding tray 7A and conveyed to the image formation section A1. A fixed process is applied to the sheet S1, onto which a toner image has been formed, while passing through the fixing section 8. The sheet S1, onto which the fixing process has been applied, will be ejected from sheet ejection rollers 7C toward outside the image forming apparatus A.

In this embodiment, the image forming apparatus A is an image forming apparatus for forming a monochrome image onto a sheet by an electro-photographic system. However, the image forming apparatus pertaining to this invention is not limited to this embodiment. It is apparent that the image forming apparatus may be a color image forming apparatus. The image forming system may be any image forming system other than the electro-photographic system.

Figure 2:
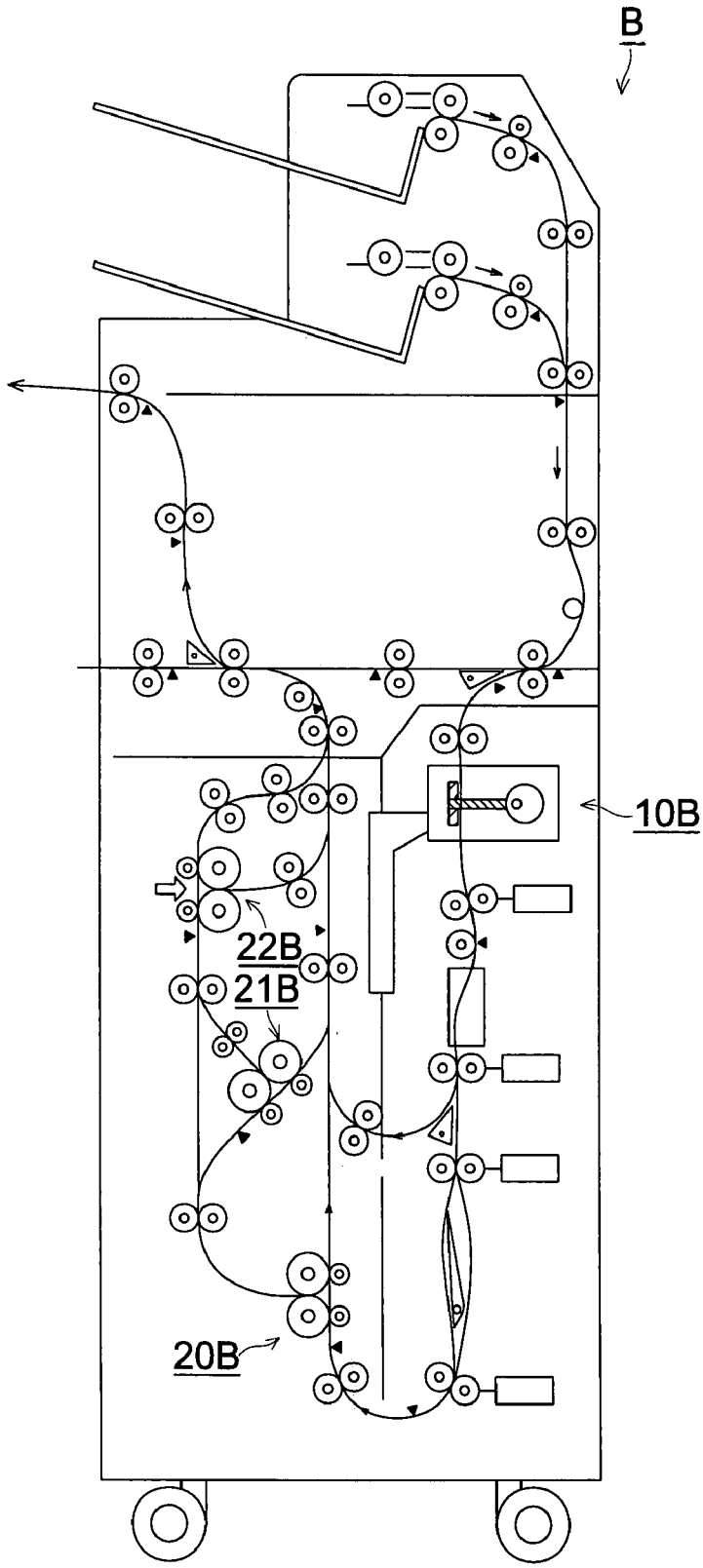
FIG. 2 illustrates a center-cross sectional view of a sheet folding apparatus B.

FIG. 2 illustrates a center-cross sectional view of a sheet folding apparatus B.

The sheet folding apparatus B is configured by a hole punch section 10B, the first folding section 20B, the second folding section 21B and the third folding section 22B. The sheet folding apparatus B is arranged to execute a hole punch process to the sheet S1 onto which an image has been formed and various folding processes (the fold-line forming section of this invention corresponds to the first folding section 20B, the second folding section 21B and the third folding section 22B).

Figure 3:
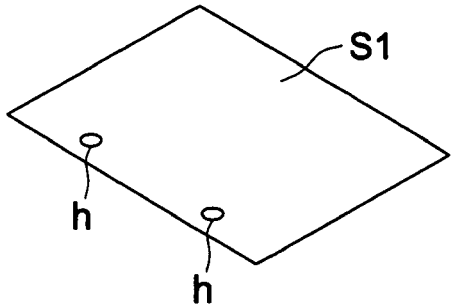
FIG. 3(*a*)-FIG. 3(*h*) illustrate perspective views of a sheet Si on which a hole punch process and various folding processes are applied.
Figure 3:
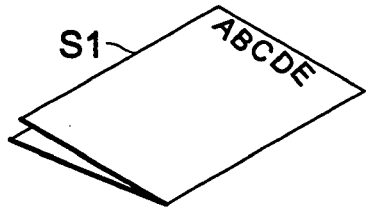
Figure 3:
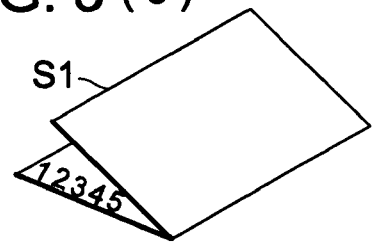
Figure 3:
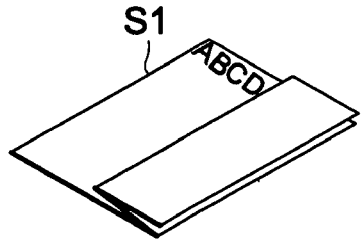
Figure 3:
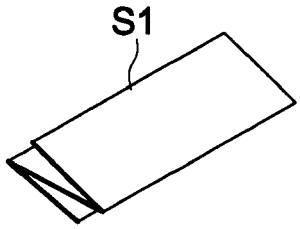
Figure 3:
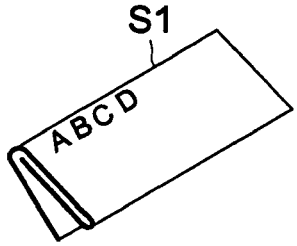
Figure 3:
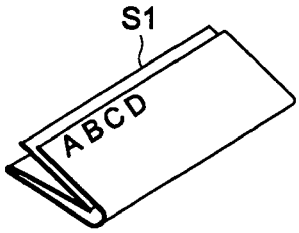
Figure 3:
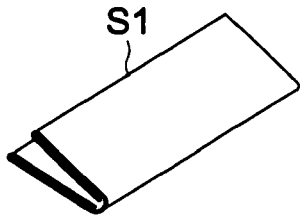

FIG. 3 illustrates a perspective view of a sheet S1 on which a hole punch process and various folding processes have been applied.

The sheet S1 illustrated in FIG. 3(*a*) is the sheet having two holes processed by a hole punch section 10B, and the sheet S1 illustrated in FIG. 3(*b*) is the sheet folded at the center by the first folding section 20B so as to face an image surface outside.

The sheet S1 illustrated in FIG. 3(*c*) is the sheet folded at the center by the third folding section 22B so as to face an image surface inside. The sheet illustrated in FIG. 3(*d*) is the sheet folded in a Z-shape by the first folding section 20B and the third folding section 22B so as to face the image surface to the inside.

The sheet S1 illustrated in FIG. 3(*e*) is the sheet folded in an outside three-folded shape by the first folding section 20B and the second folding section 21B. The sheet S1 illustrated in FIG. 3(*f*) is the sheet folded in an inside three-folded shape by the first folding section 20B and the second folding section 21B.

The sheet S1 illustrated in FIG. 3(*g*) is the sheet folded with double parallel folding process by the first folding section 20B and the second folding section 21B. The sheet S1 illustrated in FIG. 3(*h*) is the sheet folded in a four folded shape by the first folding section 20B, the second folding section 21B and the third folding section 22B.

Figure 4:
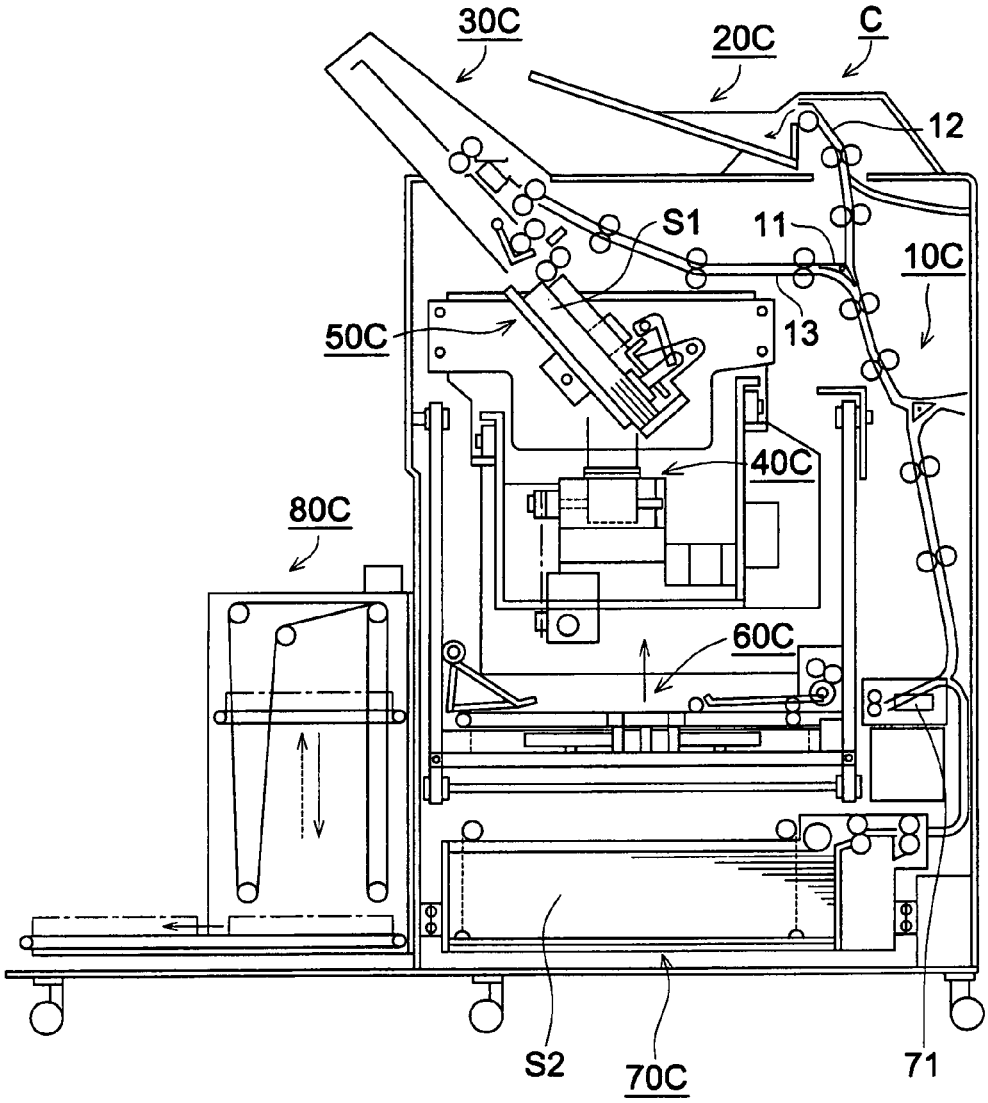
FIG. 4 illustrates a center-cross sectional view of a bookbinding apparatus C.

FIG. 4 illustrates a center-cross sectional view of a bookbinding apparatus C.

The bookbinding apparatus C bundles a plurality of sheets S1 inputted from the sheet folding apparatus B, so as to contact the cover sheet S2 to a sheet bundle comprised of a plurality of sheets S1, in a U-shaped style to create a booklet.

The bookbinding apparatus C includes a conveyance section 10C, an ejection sheet tray 20C, a sheet reversing section 30C, a coating section 40C, a collecting section 50C, a contact section 60C (being a booklet making section) for contacting the cover to the sheet bundle comprised of a plurality of sheets S1, a cover storage section 70C and a booklet ejection section 80C. The sheet S1 conveyed to the bookbinding apparatus C is either ejected to the ejection sheet tray 20C through an ejection path 12 or conveyed to the sheet reversing section 30C by the switching gate 11 provided in the conveyance section 10C. The sheets S1 will be ejected to the ejection sheet tray 20 when the bookmaking apparatus C does not make a booklet, or the coversheet CV is ejected to the ejection sheet tray 20 when the coversheet CV is not processed by the sheet folding apparatus B. In the bookmaking apparatus C, the sheet S1 is conveyed to the sheet reversing section 30C through conveyance path 13, and after having switched back at the sheet reversing section 30C, the sheet S1 is conveyed to the collecting section 50C. In the collecting section 50C, when the sheets S1 have been collected and reached to a setting number, the collecting section 50C will rotate and the sheet bundle comprised of a plurality of sheets S1 is held in a vertical state. Then adhesive agent is coated on the lower surface, which is a spine of the sheet bundle comprised of a plurality of sheets S1, and the cover S2 is contacted and adhered to the sheet bundle. The booklet S3 made by adhering the cover S2 to the sheet bundle comprised of a plurality of sheets S1 is ejected to the booklet ejection section 80C. The cover S2 is also stored in the cover storage section 70C other than the sheet feeding tray 7B. In case when forming an image onto the cover S2, the cover S2 will be ejected from the sheet feeding tray 7B. In case when no image is formed onto the cover S2, the cover S2 will be ejected from the cover storage section 70C. In case when the cover S2 is an unsettled size having a long shape, the cover S2 will be cut at a certain length by a cutter 71 based on the size information of the sheet S1 and the thickness information of the sheet bundle comprised of a plurality of sheets S1.

Figure 5:
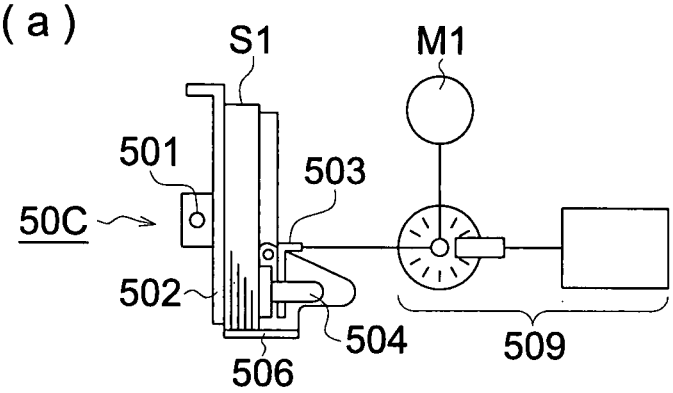
FIG. 5(*a*)-FIG. 5(*d*) illustrate processes for coating an adhesive agent on a sheet bundle comprised of a plurality of sheets S1.
Figure 5:
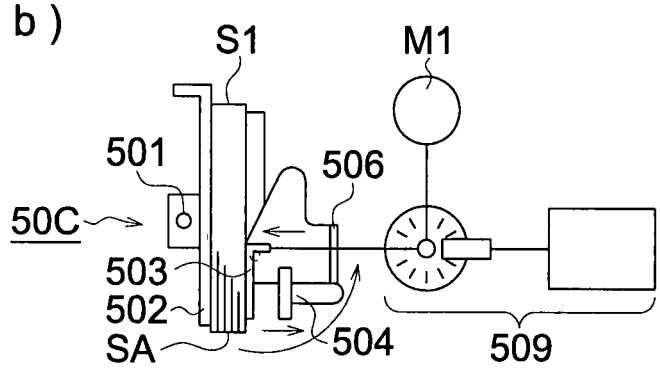
Figure 5:
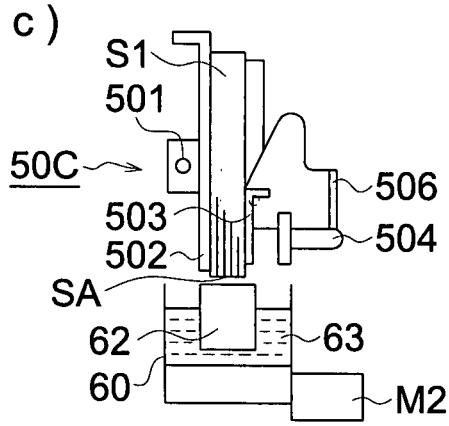
Figure 5:
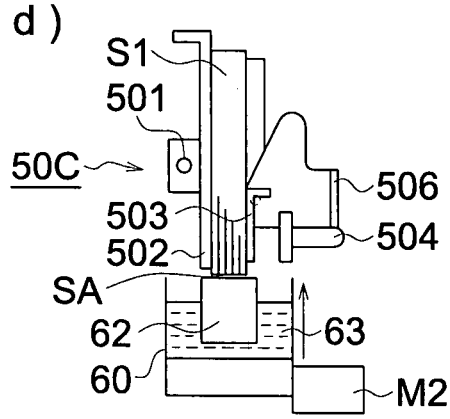

FIG. 5 illustrates a process for coating an adhesive agent on the sheet bundle comprised of a plurality of sheets S1.

A motor M1 moves the second binding member 503 toward the sheets S1. In case when the binding member pushes the sheets S1 with a constant pressure, a drive torque detection sensor detects the increase of the driving torque of the motor M1 and stops moving of the second binding member 503. Based on the structure described above, the sheet bundle is strongly bound between the first binding member 502 and the second binding member 503. The moving amount of the second binding member 503 is measured by an encoder 509 and stored in a RAM. The details of the thickness measurement of the sheet bundle will be described later.

At the step where the sheet bundle has been bound between the first binding member 502 and the second binding member 503, a receiving plate 506 rotates 90° to evacuate from a lower portion as illustrated in FIG. 5(*b*). At the step when the receiving plate 506 has been evacuated, the lower surface SA of the sheet bundle does not contact with a coating roller 62 (refer to FIG. 5(C)).

Next, as illustrated in FIG. 5(*d*), adhesive agent 63 is coated onto the lower surface SA of the sheet bundle comprised of a plurality of sheets S1, when the coating section 40C storing the adhesive agent 63 rises and the coating roller 62 contacts with the lower surface SA of the back section of the sheet bundle and moves along the lower surface SA of the sheet bundle. The motor M2 drives the coating roller 62.

Figure 6:
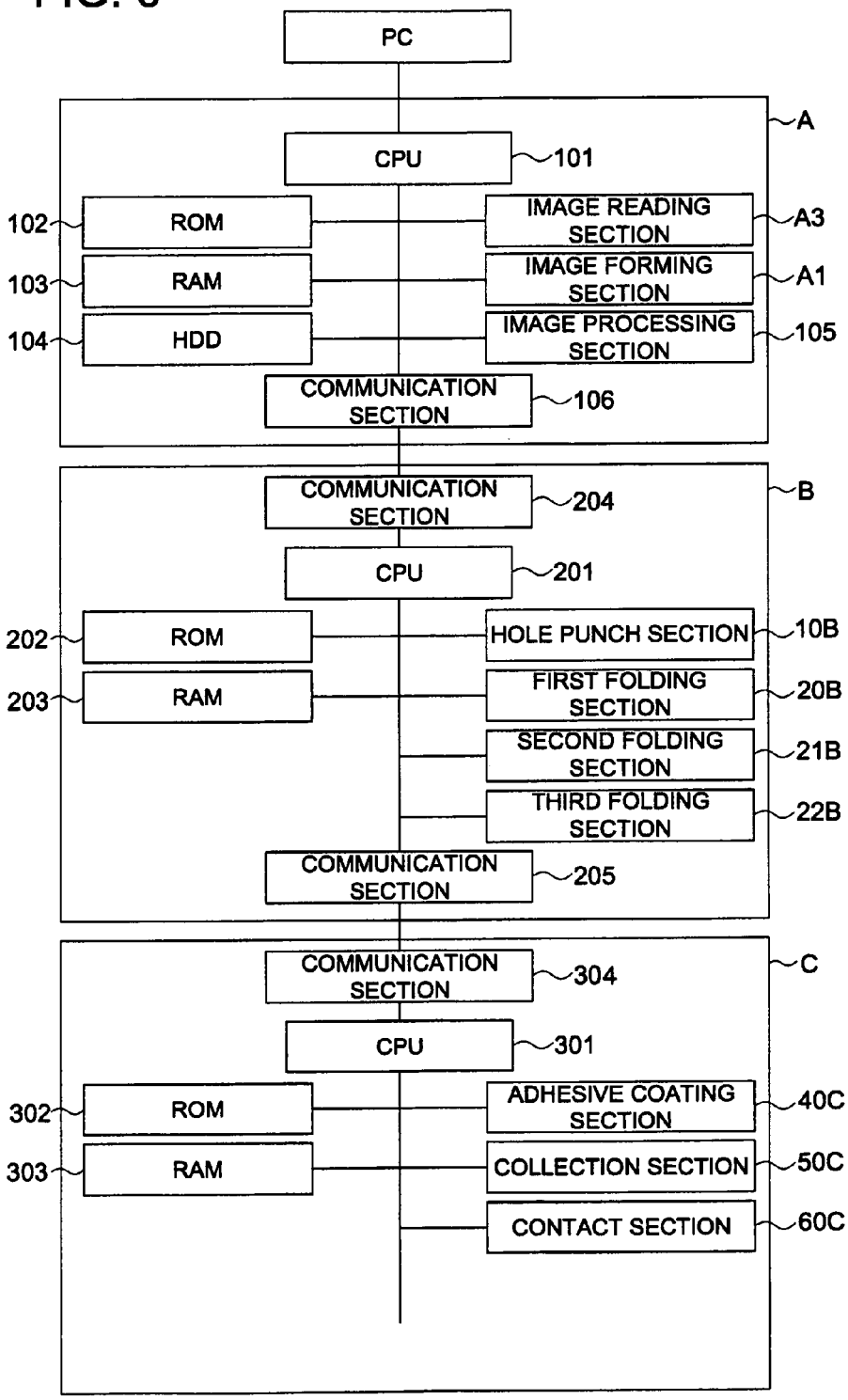
FIG. 6 illustrates a block diagram of a control system in the image forming apparatus.

FIG. 6 illustrates a block diagram of a control system in an image forming apparatus, which indicates a typical control configuration.

The image forming apparatus A, the sheet folding apparatus B and the bookbinding apparatus C are electrically connected through communication sections 106, 204, 205 and 304. The transmission and reception of control signals are mutually conducted.

A CPU (Central Processing Unit)101, which functions as a control section, is arranged to control the total operation of the image forming apparatus A and is connected with ROM (Read Only Memory)102 and RAM (Random Access Memory)103. This CPU 101 reads out various programs stored in ROM 102, extends them in the RAM 103 and controls the operation of various sections. The CPU 101 executes various processes according to the programs extended in the RAM 103 and stores the processed results to the RAM 103. Then the CPU 101 moves the processed results stored in the RAM 103 to a predetermined target storage.

The CPU 201 (being the control section) in the sheet folding apparatus B is to control the operations of the total sheet folding apparatus B, the operations of the hole punch section 10B and the first folding section 20B.

The CPU 301 in the bookbinding apparatus is to control the operation of the total bookbinding apparatus C, a coating section 40C and a collecting section 50C. That is, CPU 301 reads out various programs stored in ROM 302, extends them in the RAM 303, and controls the operation of various sections. The CPU 301 executes various processes according to the programs extended in the RAM 303 and stores the processed results to the RAM 303. Then the CPU 301 moves the processed results stored in the RAM 303 to a predetermined target storage.

In the image forming system illustrated in FIG. 1, after making booklets S3 by the bookbinding apparatus C, the sheet folding apparatus B executes the operation for forming a fold-line on the coversheet CV. Namely, the outputs of a plurality of booklets S3 and the coversheets CV having fold-lines thereon are separately conducted. In case when outputting a plurality of booklets S3 and a plurality of coversheets CV, after the bookbinding apparatus C has made and outputted the plurality of booklets S3, the sheet folding apparatus B will execute the operation of forming a fold-line on a plurality of coversheets CV.

Figure 18:
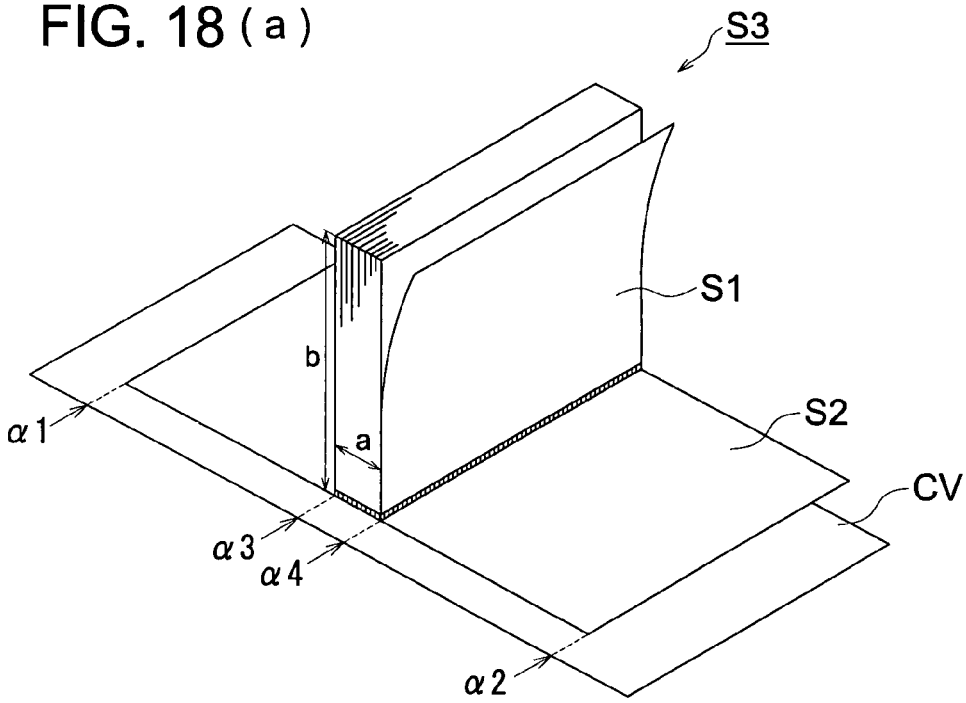
FIG. 18(*a*) and FIG. 18(*b*) illustrate drawings for describing the relationship between a sheet S1 and a cover S2 structuring a booklet S3, and a coversheet CV.
Figure 18:
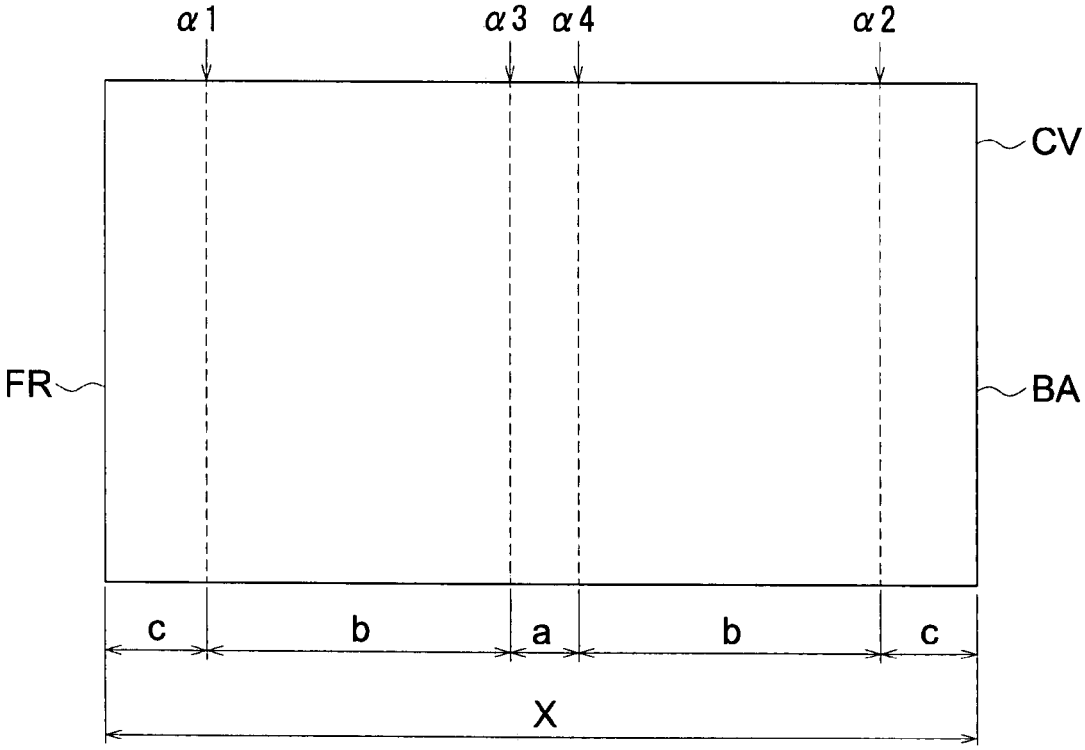

Here, a study for the position of fold-line of the coversheet CV will be conducted by using FIG. 18.

FIG. 18(*a*) illustrates a situation where the cover S2 and the coversheet CV have not been folded and FIG. 18(*b*) illustrates a situation where the coversheet S2 has been extended.

In case when the fold-line is not formed on an appropriate position of the coversheet CV, when the booklet S3 and the coversheet CV separately outputted from the image forming system are combined, since the edge of the booklet S3 and the fold-line of the coversheet CV do not match each other, appearance is not good. Accordingly, the fold-lines from the first fold-line $\alpha 1$ to the fourth fold-line $\alpha 4$ are needed to be formed at appropriate positions of the coversheet CV.

In order to form a fold-lines on appropriate positions on the coversheet CV, as illustrated in FIG. 18(*a*) and FIG. 18(*b*), the various values, such as, the length X of the coversheet CV, the thickness A (which corresponds to the spine of the booklet) of the sheet bundle comprised of a plurality of sheets S1, the lateral width B of the sheet S1 are needed to be obtained.

Since the sheet S1 and the coversheet CV are respectively stored in the sheet feeding tray 7A and 7C of the image forming apparatus A and the RAM 103 memorizes the precise size information when the sheet S1 is stored in the sheet feeding tray 7A, the length X of the coversheet CV and the lateral width of B of the sheet S1 can be obtained as correct values.

However, since the thickness A of the bundle of the sheets S1 is different each booklet, it is hard to obtain the thickness A as a correct value. Therefore, it is feasible that real thickness of the sheet bundle is measured. The detailed contents for measuring the thickness of the sheet bundle will be described hereinafter.

Figure 7:
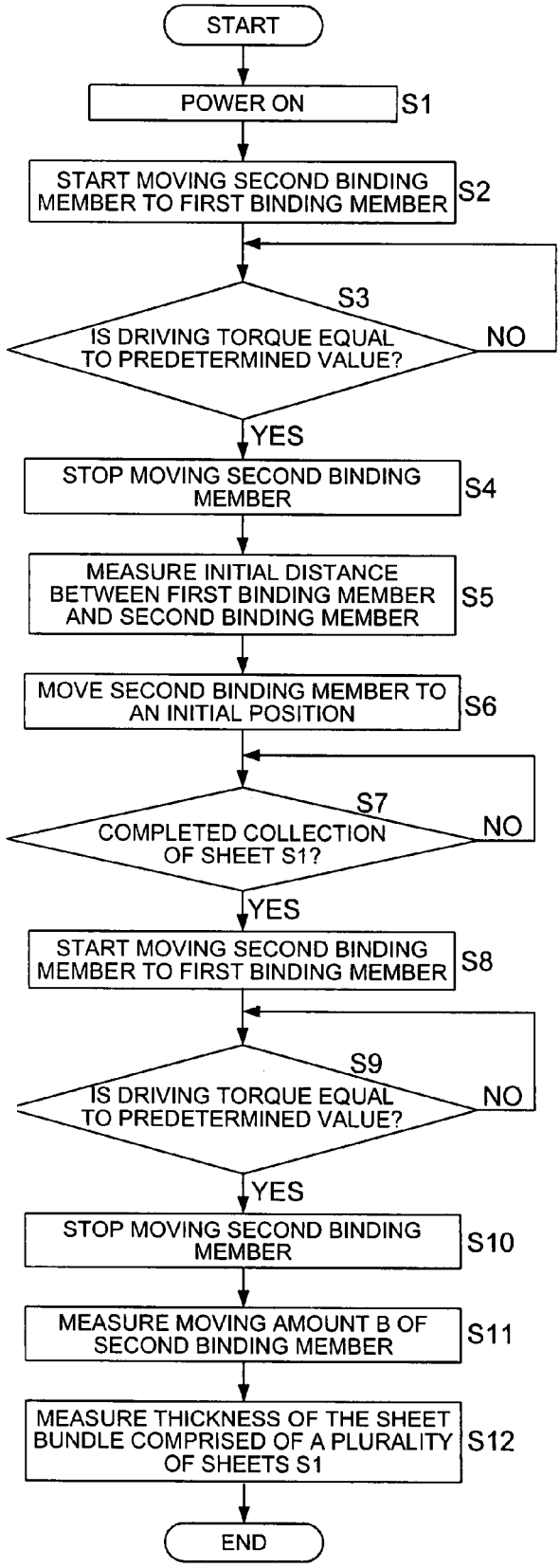
FIG. 7 illustrates a flowchart for measuring the thickness of a sheet bundle comprised of a plurality of sheets S1.
Figure 8:
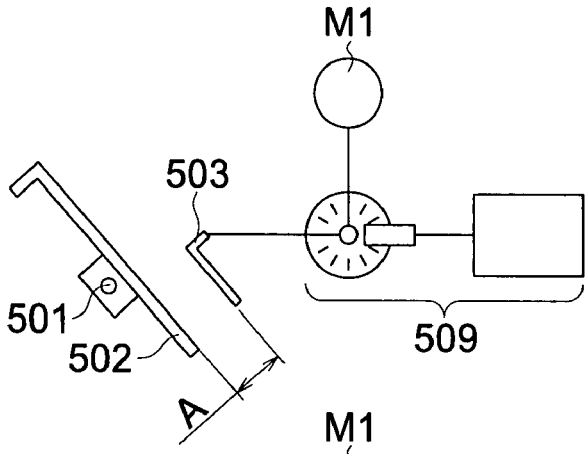
FIG. 8(*a*)-FIG. 8(*d*) illustrate drawings for explaining the operations of a first binding member 502 and a second binding member503.
Figure 8:
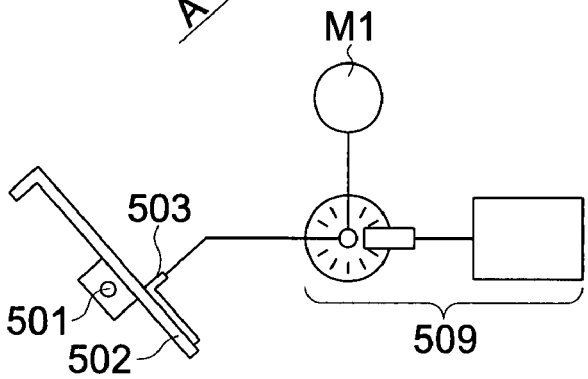
Figure 8:
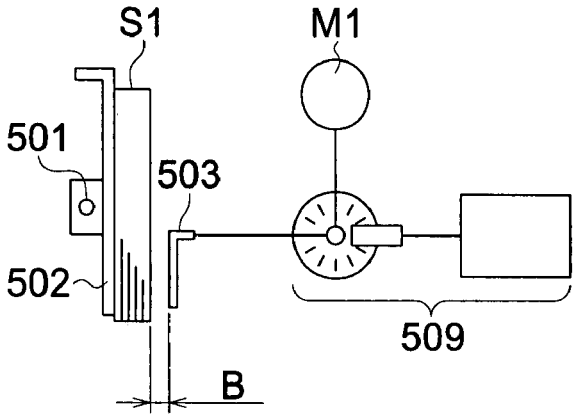
Figure 8:
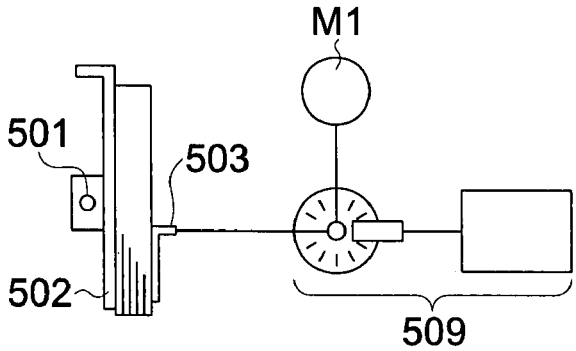

FIG. 7 illustrates a flowchart pertaining to the operation for measuring the thickness of the sheet bundle comprised of a plurality of sheets S1. FIG. 8 illustrates drawings for explaining the operations of the first binding member 502 and the second binding member 503. In FIG. 8, in order to easily understand the measurement method, unnecessary members have been omitted.

FIG. 8(*a*) illustrates the situation where the sheet bundle has not been collected between the first binding member 502 and the second binding member 503 and both binding members slant. Here, the second binding member 503 stays in an initial position. In this situation, execute measurement of the initial distance A between the first binding member 502 and the second biding member 503.

Firstly, when the power of the bookbinding apparatus C in the image forming system is turned on (step S1 in FIG. 7), the CPU 301 reads out the program for measuring the initial distance A from a RAM 303, and executes the measurement operation. The CPU 301 operates the motor 1 to move the second biding member 503 toward the binding member 502 (step S2 in FIG. 7).

Then the CPU 301 allows a drive torque detection sensor (not shown) to detect whether the torque of the motor M1 has reached to a predetermined value (step S3 in FIG. 7). In case when the drive torque detection sensor has detected the driving torque of the motor M1 has reached to the predetermined value, the CPU 301 stops moving the second binding member 503 (step S4 in FIG. 7). When the second binding member 503 stops, as illustrated in FIG. 8(*b*), the first binding member 502 and the second binding member 503 are in a situation where both of them are contacted with each other. Since the encoder 509 has measured the moving amount of the second binding member 502, this moving amount becomes the. initial distance A between the first binding member 502 and the second binding member 503 (step S5 in FIG. 7). The measured initial distance A is memorized in a RAM 303.

When having completed the measurement of the initial distance A, the second binding member will be moved to the initial position in order to collect the sheet bundle (step S6). Next, having completed the collection of the sheets S1 (step S7 in FIG. 7), the CPU 301 rotates a shaft 501 centering on itself so that the first binding member 502 and the second binding member 503 become a vertical posture from a slant posture while keeping the initial distance A.

And the thickness of the bundle of the sheets S1 is measured by a measure section of the bookbinding apparatus C. The measure section is configured by the first binding member 502, the second binding member 503, the motor M1, the drive torque detection sensor and the encoder 509 for detecting a moving amount of the second binding member.

Firstly, the CPU 301 moves the second binding member 503 to the first binding member 502 (step S8 in FIG. 7) and allows the drive torque detection sensor to detect whether the drive torque of the motor M1 has reached to a predetermined value (step S9 in FIG. 7). When the CPU 301 has detected that the drive torque of the motor M1 has reached to the predetermined value, the CPU 301 stops moving the second binding member 503 (step S10 in FIG. 7). When the movement of the second binding member 503 stops, the second binding member 503 and the sheets S1 are in the situation where both have contacted each other as illustrated in FIG. 8(*d*). The moving amount of the second binding member (corresponding to B in FIG. 8(*c*)) has been measured by the encoder 509 (step Sll in FIG. 7). Then the CPU 301 reads out the initial distance A, which has been measured, from the RAM 303 and calculates the thickness of the sheet bundle by subtracting the moving amount B from the initial distance A (step S12 in FIG. 7). The measuring method in FIG. 8 is a measuring method for measuring the thickness of the sheet bundle by moving the second binding member 503 by the motor M1. However, the measuring method is not limited to the embodiment for moving the second binding member 503 but may be an embodiment for moving the first binding member 502.

Further, the measuring method may be an embodiment for connecting motor encoders to both of the first binding member 502 and the second binding member 503 to measure the thickness of the sheet bundle by moving both binding members.

Next, the operation for forming a fold-line on the coversheet based on thickness information of the sheet bundle will be described.

Figure 9:
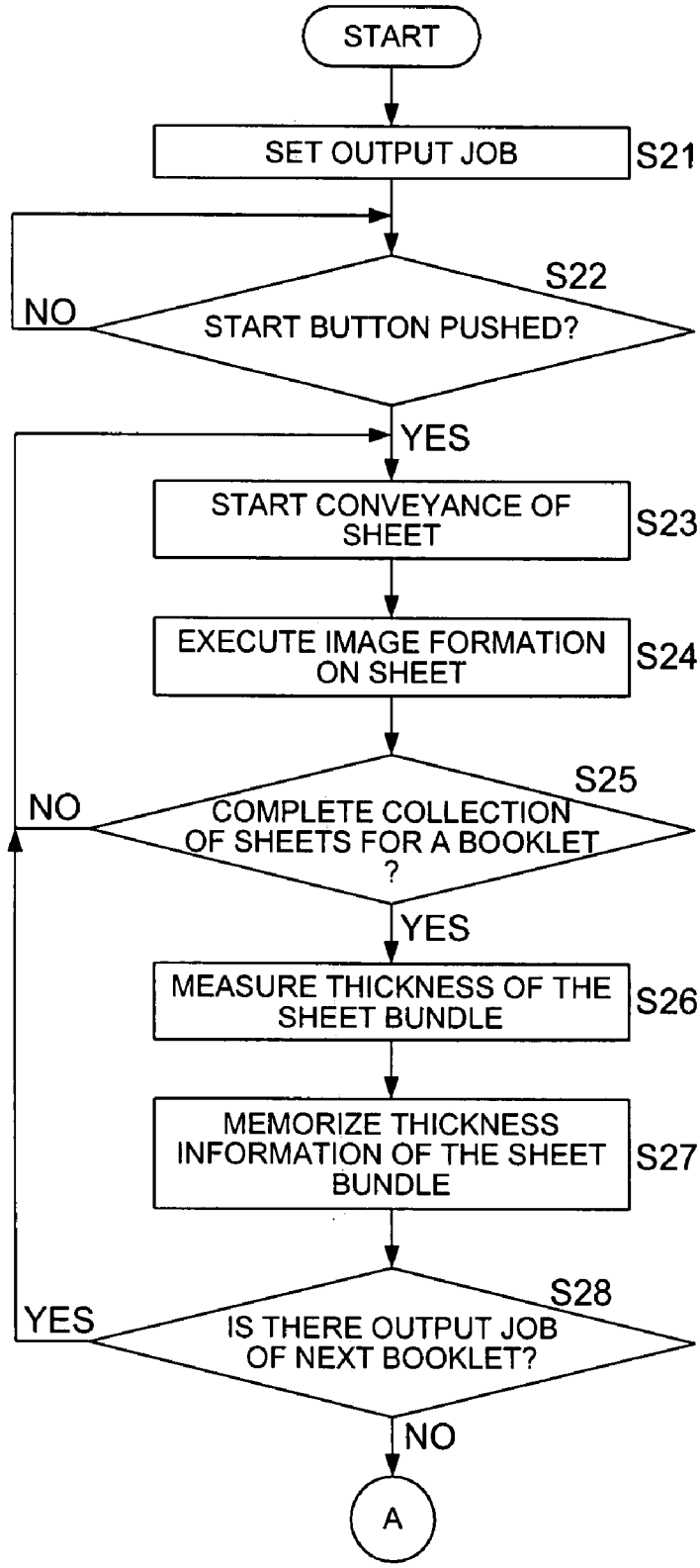
FIG. 9 illustrates a flowchart showing the operations from the step of measuring the thickness of a sheet bundle comprised of a plurality of sheets S1 to the step of memorizing the measured thickness.

FIG. 9 illustrates a flowchart showing the operations from the step of measuring the thickness of the sheet bundle comprised of a plurality of sheets S1 to the step of memorizing the measured thickness.

Firstly, setting an output job is conducted on an operation control section in the image forming apparatus A by a user (step S21). In this embodiment, it is assumed that settings for contacting the sheet bundle composed of a plurality of sheets S1 with a coversheet S2 to make a booklet S3, forming an image on a coversheet CV and forming a fold-line thereon, have been conducted.

Then, the CPU 101 determines whether a start button in the image forming apparatus A has been pushed (step S22). In case when having determined that the start button has been pushed (step S22: Yes), the CPU 101 starts conveyance of a sheet S1 from a sheet feeding tray A7 (step S23) and executes image formation on the conveyed sheet S1 (step S24). This conveyance operation and the image formation operation are conducted by the CPU 101 to control the image forming section A1.

The sheet S1 onto which an image has been formed is conveyed to the bookbinding apparatus C through the sheet folding apparatus B and collected in the collection section 50C in the bookbinding apparatus C. The CPU 301 determines whether the number of sheets S1 corresponding to a booklet has been collected in the collection section 50C (step S25). When having determined that the number of sheets S1 corresponding to a booklet has been collected (step S25: Yes), the CPU 301 measures the thickness of the bundle of collected sheets (step S26). The operation for measuring the thickness of the sheet bundle is the same as the operations explained in FIG. 7 and FIG. 8.

After having measured the thickness of the bundle of the collected sheets, the information pertaining to the measured thickness of the sheet bundle is memorized in the RAM 303 (step S27). The fold-line position on the coversheet CV and the image formation position on the coversheet CV are determined based on the memorized thickness information. This will be described in detail later.

In case when there is an output job for a next booklet in step S28 (step S28: Yes), the operations of steps S23-S27 will be repeated. In case when outputting a plurality of booklets, the thickness of the sheet bundle of each booklet is measured and the thickness information of each sheet bundle is memorized in the RAM 303.

When forming a fold-line on the coversheet CV in the sheet folding apparatus B, thickness information of the sheet bundle is transmitted from the bookbinding apparatus C to the sheet folding apparatus B and memorized in the RAM 203 in the sheet folding apparatus B. Further, when an image is formed onto the coversheets CV in the image forming apparatus A, the thickness information of the sheet bundle is transmitted from the bookbinding apparatus C to the image forming apparatus A and memorized in the RAM 103 of the image forming apparatus A.

The operation for forming a fold-line on the coversheet will be described in detail by using FIG. 10.

Figure 10:
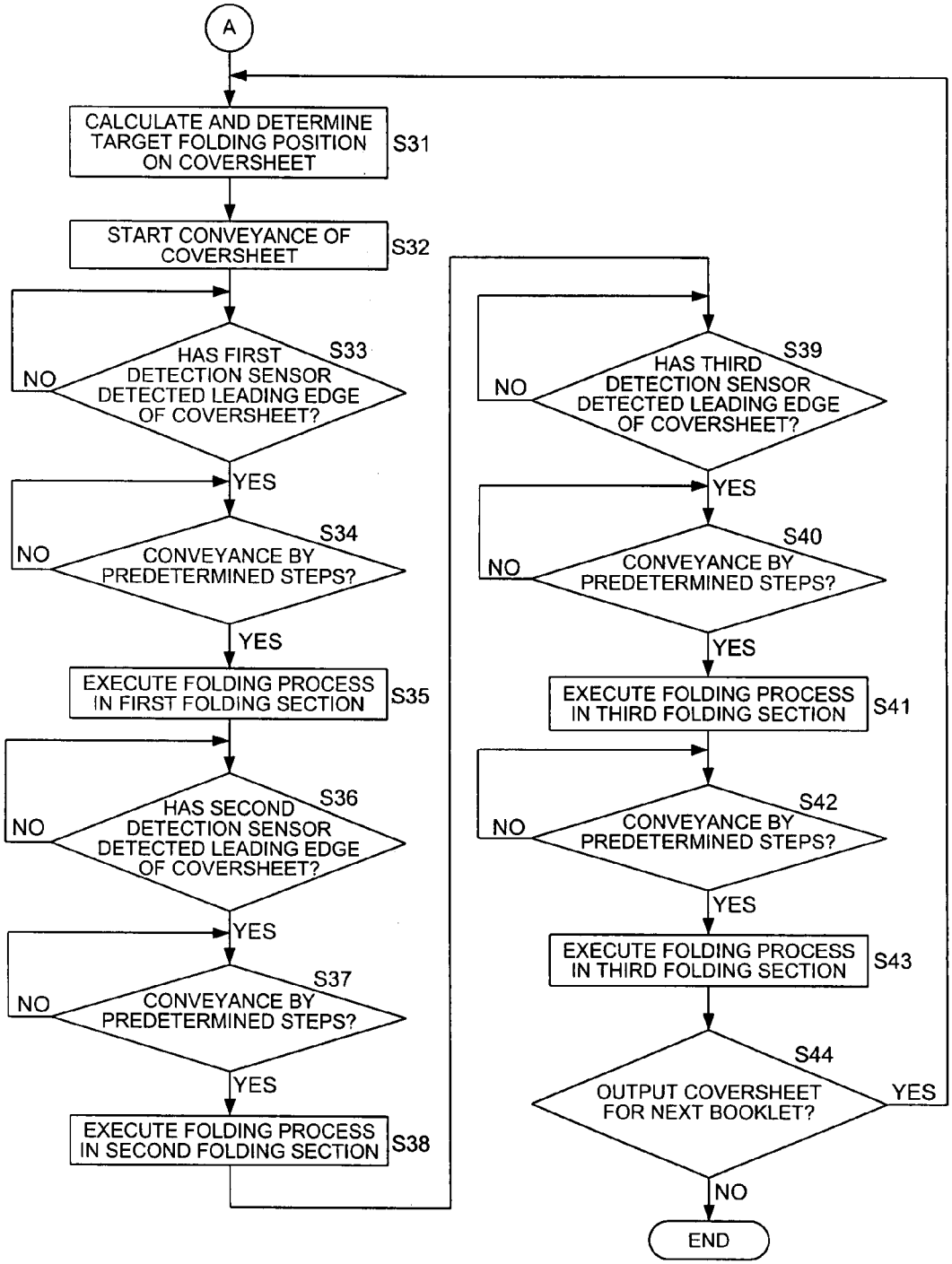
FIG. 10 illustrates a flowchart for describing the operation for forming a fold-line on a coversheet.

The operations illustrated in FIG. 10 are successive operations illustrated in FIG. 9.

In order to form a fold-line on the coversheet CV at the appropriate position, the target folding position on the coversheet CV will be calculated and determined (step S31). The CPU 201 in the sheet folding apparatus B executes this determination operation. The CPU 201 calculates the folding position based on the size information of the coversheet CV and thickness information of the sheet bundle. This will be described in detail by using FIG. 18.

FIG. 18(*b*) is a development of the coversheet CV. Fold-lines need to be formed at four positions (α1-α4) indicated by dashed lines. Symbol α1 denotes a first fold-line, and this first fold-line α1 is formed on the coversheet CV in the first folding section 20B (refer to FIG. 2). Symbol α2 denotes a second fold-line, and this second fold-line α2 is formed on the coversheet CV in the second folding section 21B (refer to FIG. 2). Symbol α3 denotes a third fold-line, and symbol α4 denotes a fourth fold-line. The third fold-line α3 and the fourth fold-line α4 are formed on the coversheet CV in the third folding section 22B (refer to FIG. 2).

Since symbol "X", which is a length of coversheet CV and B, which is the lateral width of sheet S1 have been memorized in the RAM 103 of the image forming apparatus A, the sheet folding apparatus B obtains these memorized data, and the thickness A of the sheet bundle comprised of a plurality of sheets S1 is actually measured and the data memorized by RAM 203 will be used with it.

The length "c", which denotes the length of folded regions located in both ends of the coversheet CV will be calculated by formula (1) below.

$$c=(X-a-2b)/2 \quad (1)$$

In the step S31 in FIG. 10, the values of "X", A, B and C are obtained by this method to determine the folding positions. Then, in order to actually form fold-lines on the coversheet, the conveyance of the coversheet CV to the sheet folding apparatus B is started (step S32).

Firstly, the first folding section 20B forms the first fold-line α1 on the coversheet CV. The operations pertaining to the operations of the steps S33-S35 will be described by using FIG. 11.

Figure 11:
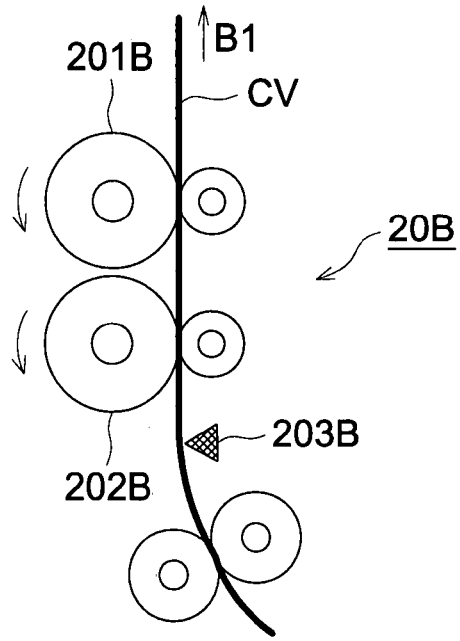
FIG. 11(*a*)-FIG. 11(*c*) illustrate magnification drawings of the first folding section 20B.
Figure 11:
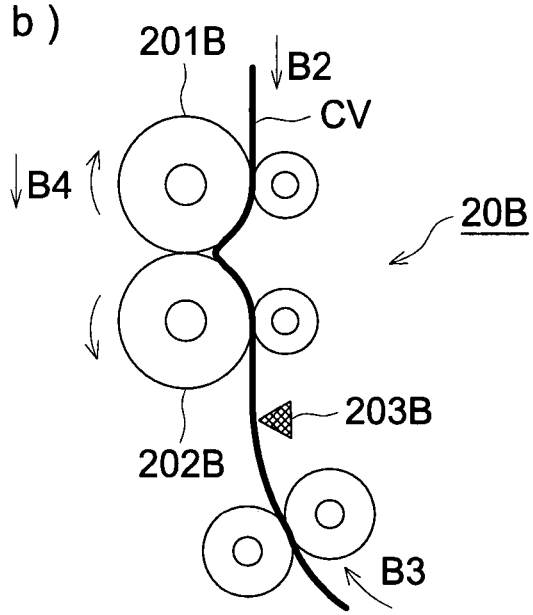
Figure 11:
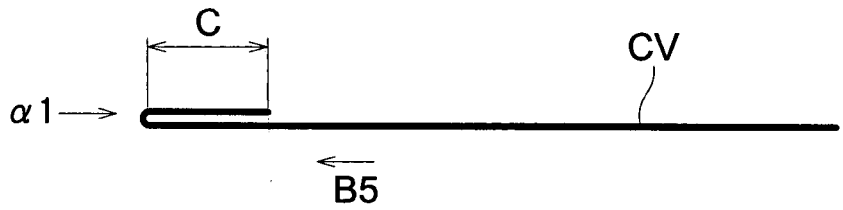

FIG. 11 illustrates a magnification drawing of the first folding section 20B.

When the coversheet CV is conveyed from the image forming apparatus A to the sheet folding apparatus B, the coversheet CV is conveyed to the first folding section 20B (refer to FIG. 2). In FIG. 11(*a*), as shown in a conveyance direction B1, the coversheet CV is conveyed from the lower portion of the first sheet folding apparatus 20B to the first folding section 20B.

In order to form the first fold-line α1 on the coversheet CV, the CPU 201 determines whether the first detection sensor 203B (a detection sensor) has detected the leading edge of the coversheet CV (step S33 in FIG. 10). In case when the first detection sensor has detected the leading edge of the coversheet CV, the coversheet CV is conveyed for predetermined steps calculated by the CPU 201 to form the first fold-line α1 at the position which is distance C apart from the leading edge FR of the coversheet CV. A stepping motor (not shown) drives conveyance rollers (a cover sheet conveyance section), such as the first folding roller 201B in the first folding section 20B. The CPU 201 controls this stepping motor to convey the coversheet CV for the predetermined steps.

When the CPU 201 determines that the coversheet CV has been conveyed for the predetermined steps (step S34: Yes in FIG. 10), the CPU 201 moves the first folding roller 201 B in the B4 direction (refer to FIG. 11(*b*)) to contact the first roller 201B with the second folding roller 202B. Then the rotational direction of the first folding roller 201B is to be changed as shown in FIG. 11(*b*). As a result, the upper portion of the coversheet CV moves in the arrow B2 direction and the lower portion of the coversheet CV moves in the arrow B3 direction. Accordingly, the coversheet CV is nipped between the first folding roller 201B and the second folding roller 202B, and the first fold-line α1 is formed at the position which is length "c" apart from the leading edge of the coversheet CV. The folding process in the first folding section 20B is conducted by the operations as described above (step S35 in FIG. 10). The coversheet CV onto which the first fold-line al has been formed is conveyed in an arrow B5 direction (refer to FIG. 11(*c*)) and to be conveyed to the second folding section 21B.

Next, the second folding section 21B forms the second fold-line α2. The operations pertaining to the operations of steps S36-S38 will be described by using FIG. 12.

Figure 12:
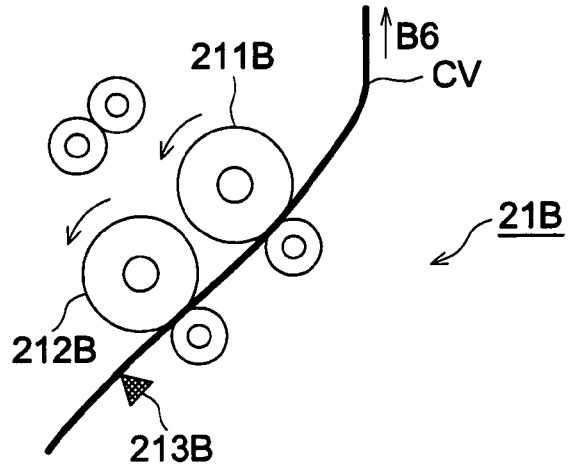
FIG. 12(*a*)-FIG. 12(*c*) illustrate magnification drawings of the second folding section 21B.
Figure 12:
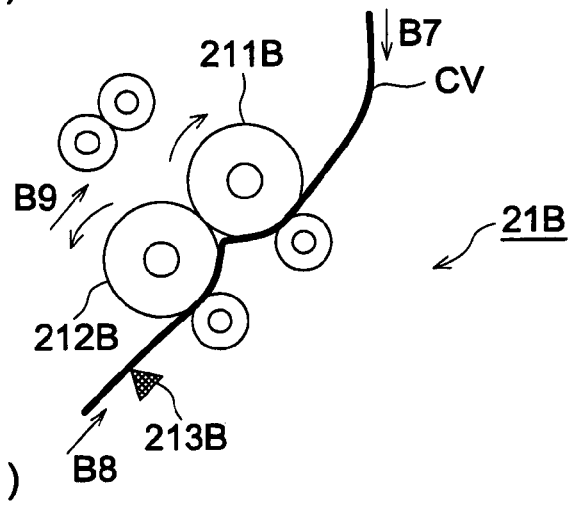
Figure 12:
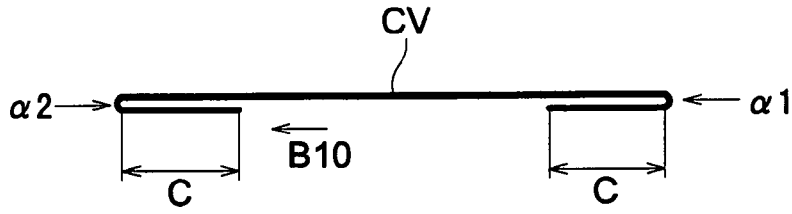

FIG. 12 illustrates a magnification drawing of the second folding section 21B.

The coversheet CV, onto which the first fold-line α1 has been formed by the first folding section 20B, is conveyed to the second folding section 21B. In FIG. 12(*a*), the coversheet CV is conveyed from the lower portion of the second folding section 21B to the second folding section 21B, as shown by arrow B6.

In order to form the second fold-line α2 onto the coversheet CV, firstly, the CPU 201 determines whether the second detection sensor 213B has detected the first fold-line α1 of the conveyed coversheet CV (step S36 in FIG. 10). When the second detection sensor 213B has detected the first fold-line α1 of the conveyed coversheet CV, the CPU 201 conveys the coversheet CV for predetermined steps calculated by the CPU 201 to form the second fold-line α2 at the position which is length "c" apart from the back edge BA of the coversheet (refer to FIG. 18). A stepping motor (not shown) drive the conveyance roller (being a cover sheet conveyance section), such as the third folding roller 211B in the second folding section 21B. The CPU 201 controls this stepping motor to convey the coversheet CV for the predetermined steps.

When the CPU 201 determines the coversheet CV has been conveyed for the predetermined steps (step S307: Yes in FIG. 10), the CPU 201 moves the fourth folding roller 212B in the arrow direction B9 (refer to FIG. 12(*b*)) to contact the third folding roller 211B with the fourth folding roller 212B. Then the rotational direction of the third folding roller 211B changes to the direction as illustrated in FIG. 12(*b*). As a result, the upper portion of the coversheet CV moves in the direction B7 and the lower portion of the coversheet moves to the direction B8. As a result, the coversheet CV is nipped between the third folding roller 211B and the fourth roller 212B, and the second fold-line α2 is formed at the position which is length "c" apart from the back edge of the coversheet CV. The folding process in the second folding section 21B is conducted by the operations as described above (step S37 in FIG. 10). The coversheet CV, onto which the first fold-line α1 the second fold-line α2 have been formed, is conveyed in an arrow direction B10 (refer to FIG. 12 (*c*)) and to be conveyed to the third folding section 22B.

Next, the third folding section 22B forms the third fold-line α3 and the fourth fold-line α4 on the coversheet CV. The operations pertaining to the operations of steps S39-S43 will be described by using FIG. 13.

Figure 13:
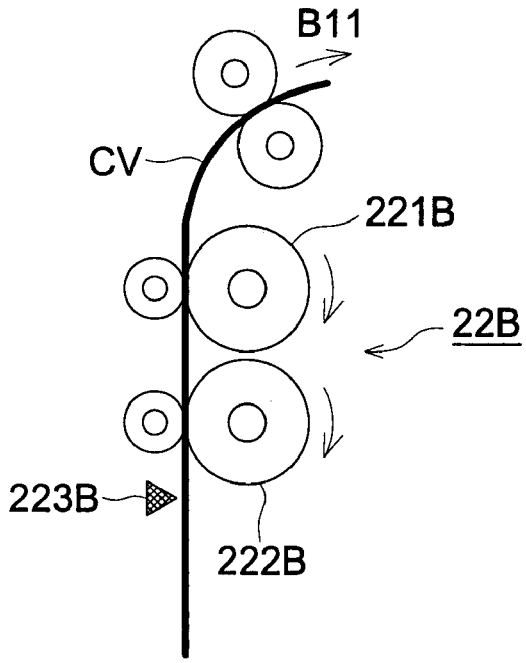
FIG. 13(*a*)-FIG. 13(*c*) illustrate magnification drawings of the third folding section 22B.
Figure 13:
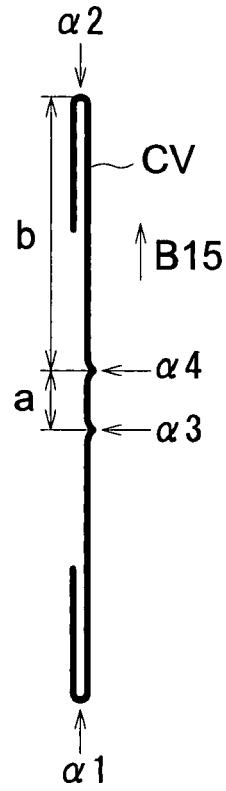
Figure 13:
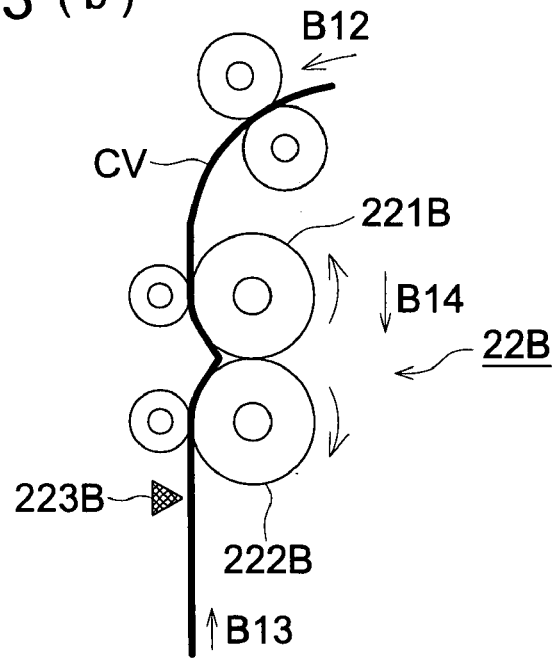

FIG. 13 illustrates a magnification drawing of the third folding section 22B.

The coversheet CV, onto which the second folding section 21B has formed the second fold-line α2, is conveyed to the third folding section 22B. In FIG. 13(*a*), the coversheet CV is conveyed from the lower portion of the third folding section 22B to the third folding section 22B.

The fourth fold-line α4 will be formed in the third folding section 22B and the third fold-line α4 will be formed after that.

In order to form the fourth fold-line α4 onto the coversheet CV, firstly, the CPU 201 determines whether the third detection sensor 223B has detected the second fold-line α2 of the conveyed coversheet CV (step S39 in FIG. 10). When the third detection sensor 223B has detected the second fold-line α2 of the conveyed coversheet CV, the CPU 201 conveys the coversheet CV for predetermined steps calculated by the CPU 201 to form the fourth fold-line α4 on the position which is length "b" apart from the second fold-line α2 (refer to FIG. 18). A stepping motor (not shown) drives the conveyance roller (being a cover sheet conveyance section), such as the fifth folding roller 221B in the third folding section 22B. The CPU 201 controls this stepping motor to convey the coversheet CV for predetermined steps.

When the CPU 201 determines the coversheet CV has been conveyed for the predetermined steps (step S40: Yes in FIG. 10), the CPU 201 moves the fifth folding roller 221B in the direction B14 (refer to FIG. 13(*b*)) to contact the fifth folding roller 221B with the sixth folding roller 222B. Then the rotational direction of the fifth folding roller 221B changes to the direction as illustrated in FIG. 13(*b*). As a result, the upper portion of the coversheet CV moves in the direction B12 and the lower portion of the coversheet CV moves to an arrow direction B13. As a result, the coversheet CV is nipped between the fifth folding roller 221B and the sixth folding roller 221B, and the fourth fold-line α4 is formed at the position which is length "b" apart from the second fold-line α2. The folding process in the third folding section 22B is conducted by the operations as described above (step S41 in FIG. 10).

When the fourth fold-line α4 has been formed, in order to form a third fold-line α3, as illustrated in FIG. 13(*a*), the fifth folding roller 221B and the sixth folding roller 222B are separated from each other again, and the coversheet CV is conveyed in the direction B11.

In order to form the third fold-line α3 on the position which is length "a" apart from the fourth fold-line α4 (refer to FIG. 18), the coversheet CV is conveyed for the predetermined steps calculated by the CPU 201. When the CPU 201 has determined that the coversheet CV has been conveyed for the predetermined steps (step S42: Yes in FIG. 10), the CPU 201 moves the fifth folding roller 221B in an arrow direction B14 (refer to FIG. 13(*b*)) to contact the fifth roller 221B with the sixth folding roller 222B. Then the rotational direction of the fifth roller 221B changes as illustrated in FIG. 13(*b*). As a result, the upper portion of the coversheet CV moves in the direction B12 and the lower portion of coversheet CV moves in the arrow direction B13. Accordingly, the coversheet CV is nipped between the fifth folding roller 221B and the sixth roller 222B, and as illustrated in FIG. 13(*c*), the third fold-line α3 is formed at the position which is length "a" apart from the fourth fold-line α4. The folding process in the third folding section 22B is executed by the operations as described above (step S43 in FIG. 10). A series of folding processes is executed and the coversheet CV is ejected onto an ejection sheet tray 20C.

The explanation of the flowchart illustrated in FIG. 10 will be continued. A series of folding processes has completed, the CPU 201 determines whether the coversheet CV for the next booklet should be outputted (step S44). In case when outputting the coversheet CV for the next booklet (step S44: Yes), the operations from steps S31 to S43 will be repeated. The calculation of the folding position in the step S31 is executed based on the thickness information "a" of the sheet bundle of the booklet onto which the coversheet CV is attached. Concretely describing, for example, in case when outputting two booklets S3 and outputting two coversheets CV having fold-lines thereon, the calculation of the fold-line position of the first coversheet CV is executed based on the thickness information "a" of the sheet bundle of the first booklet S3, and the calculation of the fold-line position of the second coversheet CV is executed based on the thickness information "a" of the sheet bundle of the second booklet S3.

As described based FIG. 10-FIG. 13, based on size information of a coversheet CV, size information of a sheets S1 and at the same time, thickness information of the sheet bundle, comprised of a plurality of sheets S1, which has been measured, the fold-line positions on the coversheet CV will be determined. As a result, it becomes possible to appropriately form fold-lines on a coversheet.

Next, the operations for forming an image onto a coversheet based on the thickness information of the sheet bundle will be described.

Figure 14:
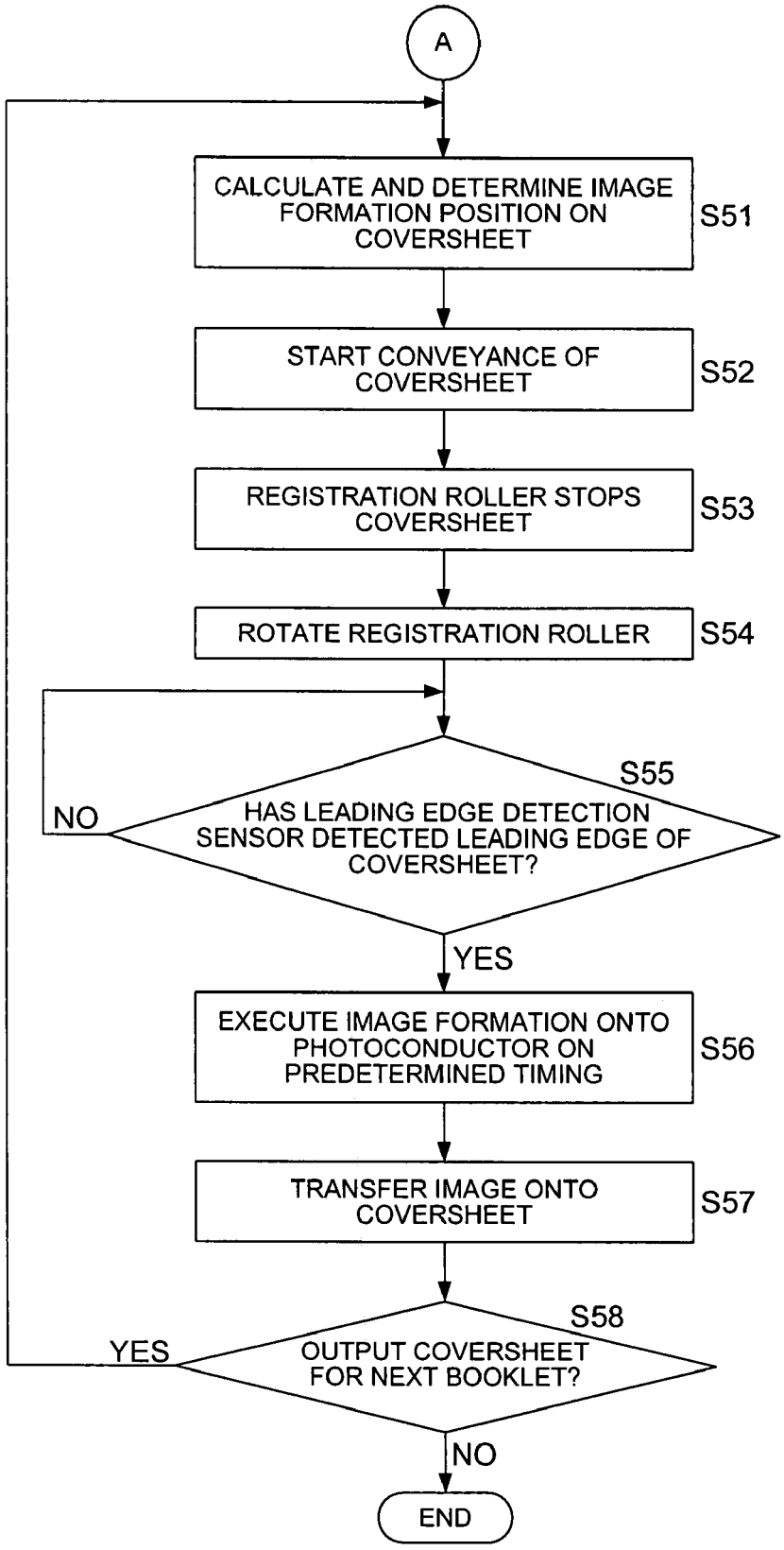
FIG. 14 illustrates a flowchart pertaining to the operation for forming an image onto a coversheet based on thickness information of the sheet bundle comprised of a plurality of sheets S1

The operations illustrated in FIG. 14 are continuation operations illustrated in FIG. 9.

Figure 15:
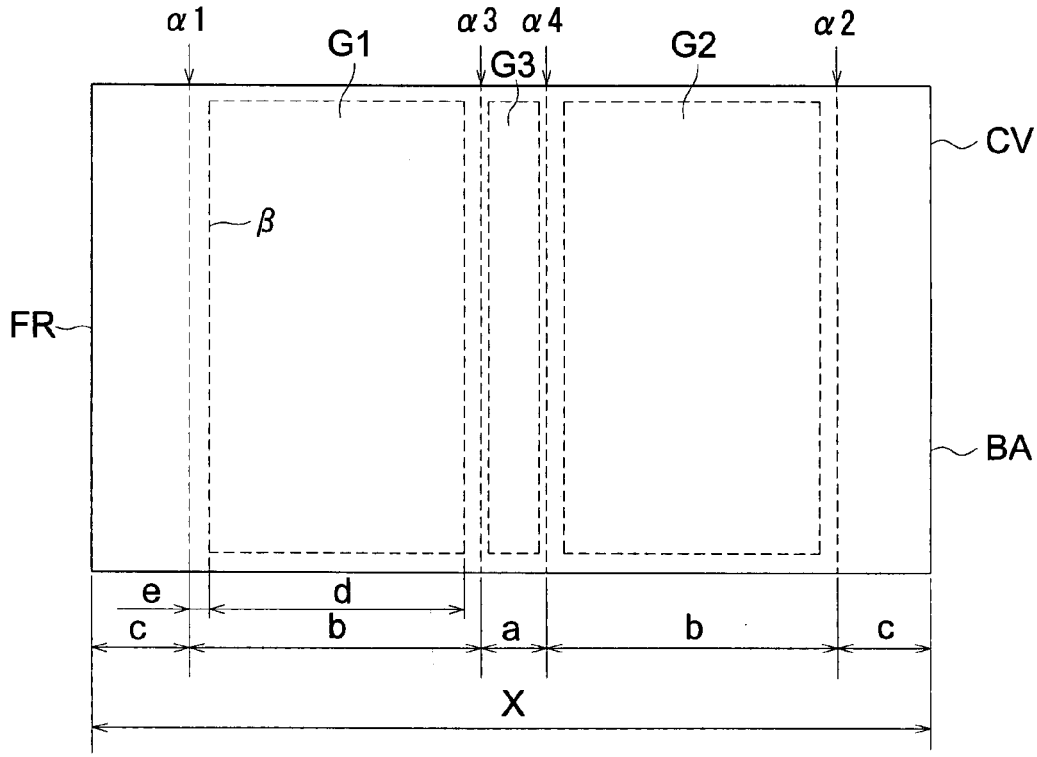
FIG. 15 illustrates a drawing for describing the image forming position on the coversheet CV.

As illustrated in FIG. 15, cover images G1 and G2, and a spine image G3 can be formed on a coversheet CV. The cover images G1 and G2 and the spine image G3 are formed on the RAM 103 of the image forming apparatus A as a synthesized image. In order to form this synthesized image on an appropriate position on the coversheet CV, the start point to start writing of an image "β" is important. The image formation position on the coversheet CV is calculated and determined in step S51 in FIG. 14. The CPU 101 in the image forming apparatus A is arranged to execute this determination operation. The image formation position is calculated and determined based on the size information of the coversheet CV, size information of the sheet S1 and the thickness information of the sheet bundle comprised of a plurality of sheets S1.

As described above, the distance "c" from the leading edge of the coversheet CV where the first fold-line al has been formed can be calculated by the formula (1).

The length "e" from the first fold-line α1 to the start point to start writing of an image "⊖" can be calculated by using a formula (2) below, based on the lateral width of the sheet S1 and a print area length "d" of the cover image G1.

$$e=(b-d)/2 \tag{2}$$

Since the length from the leading edge FR of the coversheet CV to the start point to start writing of an image "β" becomes "c+e", the image forming position on the coversheet CV can be determined by calculating this length.

The explanation of the flowchart illustrated in FIG. 14 will be continued.

After having calculated the image formation position on the coversheet CV (step S51), coversheet feeding will be started (step S52).

Figure 16:
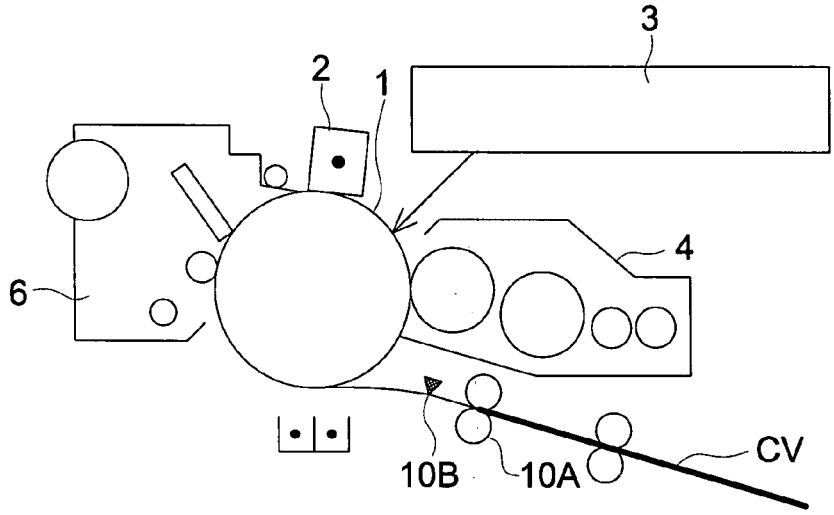
FIG. 16 illustrates a magnification drawing of an image forming section A1 of the image forming apparatus A.
Figure 17:
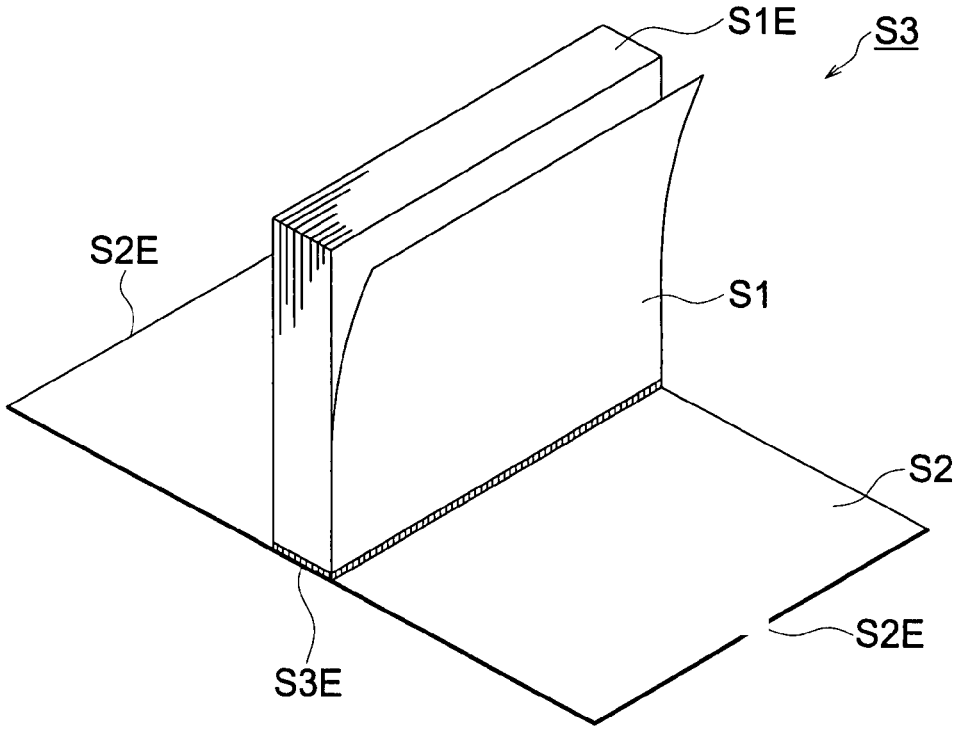
FIG. 17(*a*) and FIG. 17(*b*) illustrate drawings for describing an example of a booklet made by a sheet processing apparatus.
Figure 17:
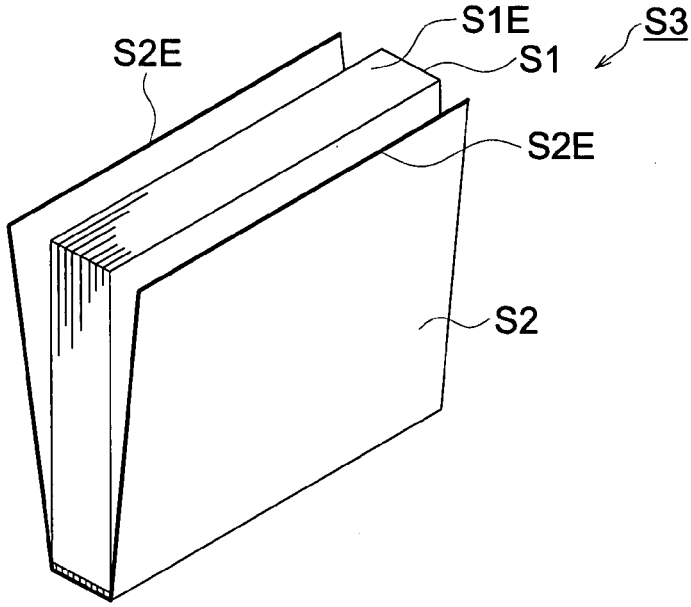

The coversheet CV, ejected from the sheet feeding tray 7C, is stopped at the registration roller 10A, as illustrated in FIG. 16 (step S53). By temporally stopping the coversheet CV at the registration roller 10A, it becomes possible to appropriately match the positioning of the image to be formed on the photoconductor 1 and the coversheet CV and to remove the slant of the coversheet CV.

Then, the registration roller 10A is rotated again (step S54). The CPU 101 determines whether the leading edge detection sensor 10B set on the conveyance path has detected the leading edge of the coversheet CV (step S55). This is conducted to adjust the write timing of the exposure section 3 to the photoconductor 1.

In case when the leading edge detection sensor 10B has detected the leading edge of the coversheet CV (step S55: Yes), the CPU 101 executes the image formation onto the photoconductor based on the information of the image formation position calculated in step S51 (step S56). The CPU 101 controls the image formation operation in the image forming apparatus.

An image is transferred onto the coversheet CV (step S57), and whether the coversheet for the next booklet should be outputted is determined (step S58). In case when outputting the coversheet for the next booklet (step S58: Yes), the steps from S51 to S58 will be repeated. The calculation of the image formation position in the step S51 is conducted based on the thickness information "a" of the sheet bundle of the booklet for which the coversheet CV is outputted. Concretely describing, for example, in case when outputting two booklets S3 and outputting two coversheets CV, onto which an image has been formed, the calculation of the image formation position of the first coversheet CV is executed based on the thickness information "a" of the sheet bundle of the first booklet S3, and the calculation of the image formation position of the second coversheet CV is executed based on the thickness information "a" of the sheet bundle of the second booklet S3.

As described based on FIG. 14-FIG. 16, it becomes possible to form an image on an appropriate position on the coversheet by determining the image formation position of the coversheet CV based on the size information of the coversheet CV, the size information of the sheet S1 and the actually measured thickness information of the sheet bundle comprised of a plurality of sheets S1.

Embodiments of this invention have been described based on drawings. However, the present invention is not limited to the above embodiments and various changes, and modifications may be made without departing from the scope of the invention.

According to a sheet process apparatus of this invention, it becomes possible to form fold-lines on an appropriate position on a coversheet. Further, according to an image forming system of this invention, it becomes possible to form and image on an appropriate position on a coversheet.

What is claimed is:

1. A sheet processing apparatus, comprising:

a booklet making section for making a booklet by covering a sheet bundle comprising a plurality of sheets with a cover in a U-shape;

a fold-line forming section for forming fold-lines on a coversheet, which covers the booklet made by the booklet making section, the fold-line forming section comprising:

a first folding section which conveys the coversheet while forming a first fold-line at a first end area of the coversheet;

a second folding section which conveys the coversheet while forming a second fold-line at a second end area of the coversheet; and a third folding section which forms a third fold-line and a fourth fold-line at a central area of the coversheet;

a coversheet conveyance section for conveying the coversheet;

a measurement section for measuring a thickness of the sheet bundle; and a control section for controlling operations of the coversheet conveyance section and the fold-line forming section to determine folding positions on the coversheet and form the fold-lines at the folding positions, wherein the folding positions are determined based on size information of the coversheet, size information of a sheet of the sheet bundle, and thickness information of the sheet bundle measured by the measurement section, and wherein the fold-line forming section is adapted to perform center-folding, three-folding, and four-folding of a sheet.

2. The sheet processing apparatus of claim 1, further comprising a detection sensor for detecting the coversheet, wherein the detection sensor is provided on a conveyance path on which the coversheet is conveyed by the coversheet conveyance section, and wherein the control section controls the coversheet conveyance section based on a signal detected by the detection sensor.

3. The sheet processing apparatus of claim 1, wherein the measurement section comprises:

a first binding member for binding the sheet bundle;

a second binding member which is disposed at an initial distance from the first binding member, at an initial position; and a driving section for moving the second binding member from the initial position, wherein the thickness of the sheet bundle is measured when the sheet bundle is bound between the first binding member and the second binding member.

4. The sheet processing apparatus of claim 3, wherein the measurement section measures the thickness of the sheet bundle based on the initial distance from the first binding member, and a moving amount of the second binding member from the initial position of the second binding member.

5. An image forming system including an image forming apparatus and a sheet processing apparatus, the sheet processing apparatus comprising:

a booklet making section for making a booklet by covering a sheet bundle comprising a plurality of sheets with a cover in a U-shape;

a fold-line forming section for forming fold-lines on a coversheet which covers the booklet made by the booklet making section, the fold-line forming section comprising:

a first folding section which conveys the coversheet while forming a first fold-line at a first end area of the coversheet;

a second folding section which conveys the coversheet while forming a second fold-line at a second end area of the coversheet; and a third folding section which forms a third fold-line and a fourth fold-line at a central area of the coversheet;

a measurement section for measuring a thickness of the sheet bundle; and a control section for controlling operations of the image forming apparatus to determine an image forming position on the coversheet and to form an image on the image forming position, which has been determined based on size information of the coversheet, size information of a sheet of the sheet bundle, and thickness information of the sheet bundle.

6. The image forming system of claim 5, wherein the measurement section comprises:

a first binding member for binding the sheet bundle;

a second binding member which is disposed at an initial distance from the first binding member, at an initial position; and a driving section for moving the second binding member from the initial position, wherein the thickness of the sheet bundle is measured when the sheet bundle is bound between the first binding member and the second binding member.

7. The image forming system of claim 6, wherein the measurement section measures the thickness of the sheet bundle based on the initial distance between the first binding member and the second binding member, and a moving amount of the second binding member from the initial position of the second binding member.

8. The image forming system of claim 5, wherein the sheet processing apparatus further comprises an information sending section which sends information on the thickness of the sheet bundle, measured by the measurement section, to the fold-line forming section, and wherein after the fold-line forming section forms the fold-lines, based on the information on the thickness, the sheet processing apparatus ejects the coversheet with the fold-lines to an exterior of the sheet processing apparatus.

* * * * *